US005375386A

United States Patent [19]

Goad

[11] Patent Number: 5,375,386

[45] Date of Patent: Dec. 27, 1994

[54] WATERSTOP/MECHANICAL SEAL

[75] Inventor: Michael E. Goad, Fenton, Mo.

[73] Assignee: Greenstreak Plastic Products Company, Inc., St. Louis, Mo.

[21] Appl. No.: 96,188

[22] Filed: Jul. 26, 1993

[51] Int. Cl.[5] ..... H01C 11/10

[52] U.S. Cl. ..... 52/396.03; 404/69

[58] Field of Search ..... 52/396, 573, 396.03; 404/64–69, 51

[56] References Cited

U.S. PATENT DOCUMENTS

| | | | |
|---|---|---|---|
| 3,88,599 | 6/1975 | Reifsnyder | 404/69 |
| 2,228,052 | 1/1941 | Gardner | 52/396 |
| 3,114,219 | 12/1963 | Bradley | 52/127.3 |
| 3,411,260 | 11/1968 | Dill | 52/396 |
| 3,455,215 | 7/1969 | Webb | 404/69 |
| 3,469,510 | 9/1969 | Worson | 404/69 |
| 3,575,094 | 4/1971 | Hewitt | 404/65 |
| 3,829,599 | 8/1974 | Fujioka | 174/48 |
| 4,050,206 | 9/1977 | Utsuyama | 52/396 |
| 4,127,350 | 11/1978 | Weber | 404/65 |
| 4,198,176 | 4/1980 | Bentz | 404/68 |
| 4,359,295 | 11/1982 | Honegger et al. | 404/68 |
| 4,848,044 | 7/1989 | LaRoche et al. | 52/58 |

FOREIGN PATENT DOCUMENTS

| | | | |
|---|---|---|---|
| 1309406 | 10/1962 | France | 52/396 |
| 2738429 | 3/1979 | Germany | 404/69 |
| 930627 | 7/1963 | United Kingdom | 52/396 |

*Primary Examiner*—James L. Ridgill, Jr.

*Attorney, Agent, or Firm*—Polster, Lieder, Woodruff & Lucchesi

[57] ABSTRACT

A waterstop/mechanical seal for use with an expansion board providing a watertight seal between adjacent concrete sections. The waterstop/mechanical seal comprises a continuous diaphragm element for covering one end area of the expansion board when positioned between the adjacent concrete sections. The waterstop/mechanical seal includes a top portion adapted to lie in general co-planar relationship with an upper surface of the adjacent concrete sections. Spaced sidewalls are integrally connected to and extend a predetermined distance downwardly from the top portion along an outside surface adjacent to one end area of the expansion board. Each of the sidewalls include at least one arm projecting laterally outwardly and spaced below the top portion, which arms are provided with a plurality of waterstop means for channeling liquid away from the expansion board. A sealing means is positioned in the area of juncture between the top portion and depending sidewalls to restrict entry of liquid between the adjacent concrete sections. Thus the waterstop/mechanical seal forms a continuous cover and seal to protect the expansion board as well as the adjacent concrete sections from outside foreign matter originating above the adjacent concrete sections.

10 Claims, 1 Drawing Sheet

WATERSTOP/MECHANICAL SEAL

BACKGROUND OF THE INVENTION

The present invention relates to concrete joint sealing devices, and more particularly, to a waterstop/mechanical seal for use with an expansion board.

When concrete slabs are positioned adjacent to one another, the space between the slabs forms an alluring trap for liquid accumulation. Liquid accumulation detrimentally affects the concrete causing deterioration and buckling. In addition to concrete damage, the collection of liquids degrades expansion boards which are placed between the slabs to accomodate joint expansion.

Several attempts have been made in the prior art to extend the life of concrete by preventing liquid permeation into concrete joint areas and expansion boards. One method is to chemically treat the expansion boards placed between adjacent slabs of concrete. The chemicals waterproof the board, making it resistant to liquid penetration. Unfortunately, despite the preservation benefits of chemicals, they damage the environment and sometimes discolor the boards and the surrounding concrete.

Another method of protecting the joint areas includes covering the joints with concrete joint sealing devices generally consisting of a caulking or sealant material. These devices cover the joints and restrict the entry of liquid between adjacent concrete sections but do not specifically protect the expansion boards. In addition, most of the sealants used in these devices have minimal durability and elasticity. The sealants do not always endure expansion, contraction and other movements of the concrete that result from outside pressures. Sealants also fail due to improper preparation and poor handling to the concrete. Furthermore, some of the sealants used in these devices react with adjacent metal structures, reinforcing bars or additives incorporated into the concrete. Occasionally, these reactions result in concrete and expansion board deterioration.

While all of the aforementioned examples have solved some of the problems associated with concrete joint areas, several limitations remain which have not been solved by prior art designs.

SUMMARY OF THE INVENTION

Among the several objects and the advantages of the present invention:

the provision of a waterstop/mechanical seal for use with an expansion board which overcomes all of the aforenoted limitations of the prior art;

the provision of the aforementioned waterstop/mechanical seal for use with an expansion board which provides a continuous water tight diaphragm preventing the passage of fluid or the like to concrete joints;

the provision of the aforementioned waterstop/mechanical seal for use with an expansion board which protects the expansion board and seals the concrete joints;

the provision of the aforementioned waterstop/mechanical seal for use with an expansion board which accommodates joint expansion, contraction and other lateral and transverse movements in the concrete;

the provision of the aforementioned waterstop/mechanical seal for use with an expansion board which provides high resistance to chemicals;

the provision of the aforementioned waterstop/mechanical seal for use with an expansion board which eliminates the need for caulking or sealant materials;

the provision of the aforementioned waterstop/mechanical seal for use with an expansion board which is extremely durable;

the provision of the aforementioned waterstop/mechanical seal for use with an expansion board which is cost-effective and easy to manufacture; and the provision of the aforementioned waterstop/mechanical seal for use with an expansion board which does not discolor the adjacent concrete slabs or react with adjacent metal structures or reinforcing bars, and is otherwise well adapted for the purposes intended.

The present invention provides a waterstop/mechanical seal for use with an expansion board providing a water tight seal between adjacent concrete sections, the waterstop/mechanical seal having a continuous diaphragm element for covering one end area of the expansion board, when positioned between the adjacent concrete sections. The waterstop/mechanical seal includes a top portion adapted to lie generally in coplanar relationship with an upper surface of the adjacent concrete sections, and spaced side walls integrally connected to and extending a predetermined distance downwardly from the top portion along an outside surface adjacent one end area of the expansion board. Each of the side walls includes at least one arm that projects laterally outwardly and is spaced below the top portion of the waterstop/mechanical seal. Each of the arms includes a plurality of waterstop means for channeling liquid away from the expansion board. A sealing means is positioned in the area of juncture between the top portion and the depending side walls for restricting entry of liquids between the adjacent concrete sections, whereby the waterstop/mechanical cover forms a continuous seal protecting the expansion board as well as the adjacent concrete sections from outside foreign matter originating above the adjacent concrete sections.

These and other objects and advantages of the present invention will become apparent from the description that is to follow.

BRIEF DESCRIPTION OF THE DRAWING

Corresponding reference numerals will be used throughout the various figures of the drawings.

BRIEF DESCRIPTION OF THE PREFERRED EMBODIMENT

Figure 1:
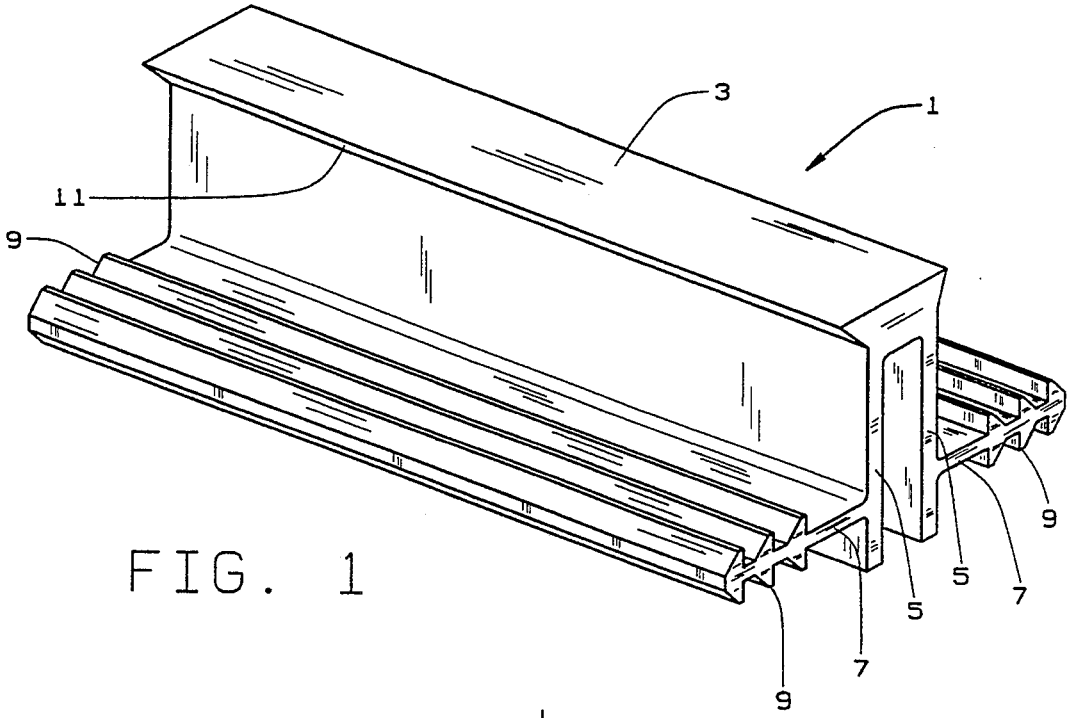
FIG. 1 is a front perspective view of the waterstop/mechanical seal for use with an expansion board which is constructed in accordance with the teachings of the present invention.

Referring now to the drawings for one illustrative embodiment of a waterstop/mechanical seal for use with an expansion board, reference numeral 1 indicates a completed assembly of the waterstop/mechanical seal.

Figure 2:
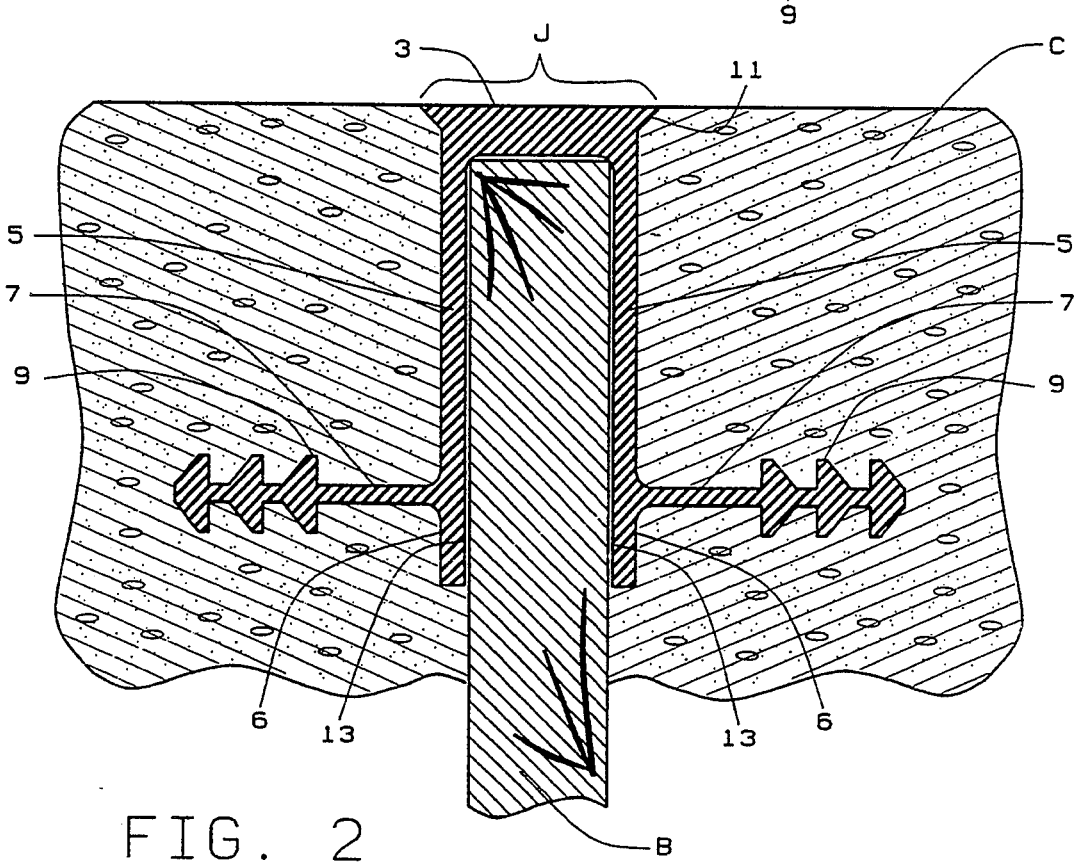
FIG. 2 is a cross-sectional view in side elevation of the waterstop/mechanical seal for use with an expansion board of the present invention where the waterstop/mechanical seal is attached to the expansion board and embedded between adjacent slabs of concrete.

The waterstop/mechanical seal shown in FIG. 1-2 forms a continuous diaphragm element between adjacent sections of concrete slabs C. Water stop/mechanical seal is attached to an expansion board B which is embedded into concrete slabs. The expansion board B has spaced end surfaces connected by elongated spaced side and edge surfaces, as will be apparent. In one embodiment, the seal secures to expansion board B by stapling side walls into the expansion board B at attachment site 13. As shown, in FIG. 2, the completed assembly 1 covers expansion board B and the joint area J so as to seal the joint J between the concrete slabs C from an invading accumulation of substances.

Water stop/mechanical seal 1 includes a top portion 3 adapted to lie in general co-planar relationship with an upper surface of adjacent concrete sections C. Integrally connected to top portion 3 are spaced sidewalls 5, which extend a predetermined distance downwardly along an outside surface adjacent one area of expansion board B. The spaced sidewalls 5 terminate in free end portions 6 which are preferably stapled or otherwise secured to the expansion board B at 13. Each of the spaced sidewalls 5 also include at least one arm 7 projecting laterally outwardly from an associated sidewall 5 and are spaced below top portion 3. As shown in the drawings, each arm 7 is more closely positioned to the free ends 6 of each sidewall 5 than the top portion 3, but could be varied to suit the arrangements desired. Each arm 7 includes a plurality of waterstop elements 9 for channeling liquid away from expansion board B and from joint area J of adjacent concrete sections C. By directing liquid away from expansion board and joint area, waterstop/mechanical seal forms a watertight closure between concrete slabs.

Specifically, waterstop/mechanical seal 1 forms a tortuous path obstructing the entrance of outside foreign matter originating above adjacent concrete sections C, into joint area J. A sealing means of waterstop/-mechanical seal comprises a beveled area 11 positioned to divert matter penetrating through the area between top portion 3 and the outer surface of concrete slabs C. Beveled area 11 includes an upwardly and outwardly beveled surface that extends from sidewalls 5 and interconnects top portion 3. Beveled area 11 forms a sealing edge between the top portion 3 of waterstop/mechanical seal 1 and the coplanar upper surfaces of adjacent concrete sections c. Invading foreign matter continues past beveled area 11 traveling downwardly along sidewalls 5 until halted by projecting arms 7. Projecting arms 7 extend outwardly from sidewalls 5 to further disrupt direct matter movement. In addition, arms 7 include waterstop elements 9 extending both upwardly and downwardly on arms 7. Waterstop elements 9 form a tortuous path hindering foreign matter entrance into joint area J and expansion board B. Water stop/mechanical seal 1 thus forms a continuous diaphragm that provides an overall obstacle obstructing the entry of matter into joint area J and expansion board B.

In one preferred embodiment, the waterstop/mechanical seal 1 is made by an extrusion molding process. Various types of material can be used; however, one preferred class of materials is thermoplastic elastomeric rubber (TPER) materials. TPER was selected for the waterstop/mechanical seal 1 because of its durability, elasticity and non-reactivity. TPER waterstop/mechanical seals also accommodate expansion, contraction and other lateral and transverse movements that could cause the concrete joints to open, close or misalign.

Water stop/mechanical seal 1 is secured to expansion board B forming an assembly that is positioned as illustrated. Subsequently, concrete is added around the entire waterstop/mechanical seal 1 and expansion board B assembly. Concrete is poured until top portion 3 is co-planar with concrete sections C. The waterstop/mechanical seal 1 forms a continuous diaphragm preventing invasion of outside foreign matter originating above concrete adjacent sections C.

In view of the above, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

I claim:

1. A waterstop/mechanical seal in combination with an expansion board in order to provide a watertight seal between adjacent concrete sections, said expansion board having spaced end surfaces connected by elongated spaced side and edge surfaces, said waterstop/mechanical seal comprising a continuous diaphragm element for covering one end area of said expansion board along one end surface and portions of said side surfaces when positioned between said adjacent concrete sections and including:

a top portion overlying one end surface of said expansion board while also being positioned in general co-planar relationship with an upper surface of said adjacent concrete sections;

spaced side walls integrally connected to and extending a predetermined distance downwardly from said top portion for a predetermined extent along the side surfaces of said expansion board adjacent the end surface of said expansion board that is overlied by said top portion, each of the side walls including at least one arm projecting laterally outwardly and spaced below the top portion, each of the arms including waterstop means for channeling liquid away from the expansion board; and sealing means positioned in the area of juncture between said top portion and depending integrally connected and spaced side walls for restricting entry of liquid between said adjacent concrete sections;

whereby the waterstop/mechanical cover forms a continuous seal protecting the expansion board as well as adjacent concrete sections from outside foreign matter originating above the adjacent concrete sections.

2. The waterstop/mechanical seal and expansion board combination as defined in claim 1 wherein said sealing means is a beveled area between said top portion and each of said side walls.

3. The waterstop/mechanical seal and expansion board combination as defined in claim 2 wherein said beveled area comprises an upwardly and outwardly beveled surface from each of said side walls that interconnects with said top portion.

4. The waterstop/mechanical seal and expansion board combination as defined in claim 1 wherein said waterstop/mechanical seal is integrally molded as a one-piece flexible element.

5. The waterstop/mechanical seal and expansion board combination as defined in claim 4 wherein the waterstop/mechanical seal is formed from a movable flexible material that accommodates lateral and transverse movements.

6. The waterstop/mechanical seal and expansion board combination as defined in claim 5 wherein said waterstop means comprises a plurality of adjacent spaced waterstop elements attached to each arm for restricting the entry of water between the adjacent concrete sections.

7. A waterstop/mechanical seal in combination with an expansion board providing a watertight seal between adjacent concrete sections, said expansion board having spaced end surfaces connected by elongated spaced side and edge surfaces, said waterstop/mechanical seal comprising a continuous diaphragm element for covering one end area of said expansion board along one end surface and portions of said spaced side surfaces when positioned between said adjacent concrete sections and including:

a top portion overlying one end surface of said expansion board while also being positioned in general co-planar relationship with an upper surface of said adjacent concrete sections; and spaced side walls integrally connected to and extending a predetermined distance downwardly from said top portion for a predetermined extent along the spaced side surfaces adjacent one end surface of the expansion board that is overlied by said top portion, each of the side walls including at least one arm projecting laterally outwardly and spaced below the top portion, each of the arms including waterstop means for channeling liquid away from the expansion board;

whereby the waterstop/mechanical cover forms a continuous seal protecting the expansion board as well as adjacent concrete sections from outside foreign matter originating above the adjacent concrete sections.

8. The waterstop/mechanical seal and expansion board combination as defined in claim 7 and further including sealing means positioned in the area of juncture between said top portion and depending integrally connected and spaced side walls for restricting entry of liquid between adjacent concrete sections.

9. In a waterstop/mechanical seal that mounts over an expansion board to provide a watertight seal between adjacent concrete sections wherein the expansion board has spaced end surfaces connected by elongated side and edge surfaces and the waterstop/mechanical seal covers one end area of the expansion board when positioned between adjacent concrete sections, the improvement comprising a waterstop/mechanical seal construction that includes:

a top portion overlying one end surface of said expansion board while also being positioned in general co-planar relationship with an upper surface of said adjacent concrete sections;

spaced side walls integrally connected to and extending a predetermined distance downwardly from said top portion for a predetermined extent along the side surfaces of said expansion board adjacent the end surface of said expansion board that is overlied by said top portion, each of the side walls including at least one arm projecting laterally outwardly and spaced below the top portion, each of the arms including waterstop means for channeling liquid away from the expansion board; and sealing means positioned in the area of juncture between said top portion and depending integrally connected and spaced side walls for restricting entry of liquid between said adjacent concrete sections;

whereby the waterstop/mechanical cover forms a continuous seal protecting the expansion board as well as adjacent concrete sections from outside foreign matter originating above the adjacent concrete sections.

10. In a waterstop/mechanical seal that mounts over an expansion board to provide a watertight seal between adjacent concrete sections wherein the expansion board has spaced end surfaces connected by elongated side and edge surfaces and the waterstop/mechanical seal covers one end area of the expansion board when positioned between adjacent concrete sections, the improvement comprising a waterstop/mechanical seal construction that includes:

a top portion overlying one end surface of said expansion board while also being positioned in general co-planar relationship with an upper surface of said adjacent concrete sections; and spaced side walls integrally connected to and extending a predetermined distance downwardly from said top portion for a predetermined extent along the spaced side surfaces adjacent one end surface of the expansion board that is overlied by said top portion, each of the side walls including at least one arm projecting laterally outwardly and spaced below the top portion, each of the arms including waterstop means for channeling liquid away from the expansion board;

whereby the waterstop/mechanical cover forms a continuous seal protecting the expansion board as well as adjacent concrete sections from outside foreign matter originating above the adjacent concrete sections. originating above the adjacent concrete sections.

* * * * *